US006951414B2

(12) United States Patent
Amano

(10) Patent No.: US 6,951,414 B2
(45) Date of Patent: Oct. 4, 2005

(54) VEHICULAR LAMP

(75) Inventor: Yasuyuki Amano, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 94 days.

(21) Appl. No.: 10/615,822

(22) Filed: Jul. 9, 2003

(65) Prior Publication Data

US 2004/0008516 A1 Jan. 15, 2004

(30) Foreign Application Priority Data

Jul. 10, 2002 (JP) ..... 2002-201317

(51) Int. Cl.[7] ..... F21V 9/00
(52) U.S. Cl. ..... 362/511; 362/520; 362/326
(58) Field of Search ..... 362/507, 511, 362/520, 545, 326–328, 331

(56) References Cited

U.S. PATENT DOCUMENTS 5,054,885 A * 10/1991 Melby ..... 359/618
5,453,855 A * 9/1995 Nakamura et al. ..... 349/58
5,890,794 A * 4/1999 Abtahi et al. ..... 362/294
6,234,646 B1 * 5/2001 Ito ..... 362/235
6,280,480 B1 * 8/2001 Tuttle et al. ..... 362/518
6,814,475 B2 * 11/2004 Amano ..... 362/487

FOREIGN PATENT DOCUMENTS

DE 196 38 081 3/1998

* cited by examiner

*Primary Examiner*—Ali Alavi
(74) *Attorney, Agent, or Firm*—Koda & Androlia

(57) ABSTRACT

A vehicular lamp with an LED light source in which light from the LED light source is formed into parallel light fluxes by an optical member, and the parallel light fluxes are reflected by a reflector in the forward direction of the lamp. The bottom-face wall of the lamp body that houses the reflector has a translucent portion, and the LED light source and the optical member are disposed outside the translucent portion so that they are unrecognizable. The reflector is formed by a translucent member and is provided at a distance from the translucent portion of the lamp body and from the rear-face wall of the reflector, so that the parallel light fluxes from the optical member is subject to internal reflection.

11 Claims, 9 Drawing Sheets

VEHICULAR LAMP

BACKGROUND OF THE INVENTION

1. Field of the Invention

The present invention relates to a vehicular lamp that has an LED (Light Emitting Diode) light source.

2. Prior Art

Recently, vehicular lamps including an LED light source have been frequently employed. Here, the specification of Germany Patent Application Publication No. 19638081 describes the structure in which light from the LED light source is formed into respective parallel light fluxes through a Fresnel lens, and the resulting parallel light fluxes are reflected by a reflector in the forward direction of the lamp. The adoption of such a structure makes it possible to facilitate the reflection control of the reflector over the light from the LED light source.

However, in the vehicular lamp described in the foregoing publication, because the reflector is provided in a such way as to diagonally extend from the outer edge of the Fresnel lens, even when the LED light source is lit, how the illumination of the reflector will appear when the LED light source is lit can be predicted to some extent. This causes the problem of there not being much unexpectedness in changes in the appearance of the lamp associated with turn-on of the LED light source, leading to lack in the originality in the lamp design.

SUMMARY OF THE INVENTION

The present invention is made in the light of such circumstances of prior art.

It is an object of the present invention to provide a vehicular lamp (having an LED light source) that provides unexpected changes in its appearance associated with turn-on/turn-off actions of the LED light source, thus enhancing the originality of the lamp design.

The present invention develops a structure of a lamp body and a reflector and an arrangement of an LED light source and an optical member to accomplish the above-described object.

More specifically, the above object is accomplished by a unique structure of the present invention for a vehicular lamp that comprises: an LED light source; an optical member that forms light from the LED light source into parallel light fluxes; and a reflector that reflects the parallel light fluxes, traveling from the optical member, in the forward direction of the lamp, the reflector being housed in a lamp chamber formed by a lamp body and a translucent cover which is attached to the front-end opening of the lamp body; and in the present invention,

- part of the circumferential face wall of the lamp body is formed as a translucent portion, and the LED light source and the optical member are provided outside the translucent portion; and
- the reflector is comprised of a translucent member provided at a distance from the translucent portion and from a rear-face wall of the lamp body and allows the parallel light fluxes from the optical member to undergo internal reflection in the reflector so as to be reflected in the forward direction of the lamp.

The "vehicular lamp" is not limited to a particular type of vehicular lamps. The "vehicular lamp" can be a tail lamp, a stop lamp, and the like.

The specific structure of the "optical member" is not limited as long as it can form the light from the LED light source into parallel light fluxes. The optical member can be, for instance, a Fresnel lens, a convex lens, and a concave mirror. Here, the "parallel light fluxes" are not necessarily required to be precisely parallel light fluxes, and they can be approximately parallel light fluxes.

The "translucent portion" is a portion constituted by a translucent member, and a specific position of "part of the circumferential face wall" constituted by the translucent portion is not limited particularly, and the "part of the circumferential face wall" can be the bottom-face wall, the right and left side-face walls, the top-face wall, or the like.

The specific structure of the "reflector" is not particularly limited in terms of materials, configuration and the like thereof as long as it is a translucent member provided at a distance from the translucent portion and from the rear-face wall of the lamp body and is structured to allow the parallel light fluxes from the optical member to undergo internal reflection in the reflector for reflection in the forward direction of the lamp. Thus, the "reflector" can be, for instance, a reflector that is formed in a prism configuration and the one that is formed in a mirror configuration. Furthermore, the "reflector" can be structured so as to allow a simple specular reflection of the parallel light fluxes from the optical member or to allow diffuse reflection of the parallel light fluxes from the optical member.

As seen from the above, in the vehicular lamp of the present invention, light from an LED light source is formed into parallel light fluxes by an optical member, and the resulting parallel light fluxes are reflected by a reflector in the forward direction of the lamp. The reflector is housed in a lamp chamber formed by a lamp body and a translucent cover, in which part of the circumferential face wall of the lamp body is formed as a translucent portion, and the LED light source and the optical member are provided outside the translucent portion. Further, the reflector is formed by a translucent member provided at a distance from the translucent portion and the rear-face wall of the lamp body, and it allows the parallel light fluxes from the optical member to be reflected in the forward direction of the lamp through internal reflection therein. The structure above of the present invention provides several advantages as described below.

First, it is possible to make the presence of the reflector inconspicuous when the LED light source is not lit. This is because the reflector is formed by a translucent member so as to allow the parallel light fluxes from the optical member to be reflected in the forward direction of the lamp through internal reflection. It is also possible to make the presence of the LED light source and the optical member unrecognizable when the LED light source is lit and also when it is not lit. This is because they are provided outside the translucent portion that forms a part of the circumferential face wall of the lamp body.

Furthermore, the reflector is provided in a position that is at a distance from the translucent portion and from the rear-face wall of the lamp body, and this makes it possible for the reflector to appear to be lit as if the reflector is suspended in midair within the lamp chamber when the LED light source is lit. Moreover, when the LED light source is lit, how the reflector is lit is unrecognizable, because the LED light sources and the optical members are provided outside the translucent portion.

As described above, when the LED light source is not lit, it is difficult to predict how the illumination of the reflector will appear when the LED light source is lit, and further it is possible for the reflector to appear to be lit as if the reflector is suspended in midair when the LED light source is lit. For these reasons, the lamp gives unexpected changes in its appearance when the LED light source is lit.

In this way, according to the present invention, in the vehicular lamp that has an LED light source, the lamp gives unexpected changes in its appearance in association with the turn-on/turn-off of the LED light source, thus enhancing the originality of the lamp design.

It should be noted that, in such a vehicular lamp having an LED light source as in the present invention, even when the LED light source and the optical member are provided outside the translucent portion, the structure of the lamp can be made relatively compact.

In the above structure, by way of forming the optical member to be integral with the translucent portion of the lamp body, the number of parts can be reduced, and the lamp can be made compact.

Furthermore, in the present invention, the reflector can be designed so as to extend in the right-left direction of the lamp and is supported by the lamp body at the right and left end portions thereof, and the translucent portion is provided in the bottom-face wall of the lamp body. Further, a plurality of sets of LED light sources and optical members can be provided in such a manner as to be arranged in the right-left direction. With this structure, when the LED light source is lit, the reflector appears to be lit in the form of a band-shaped luminescent portion that extends in the right-left direction as if it is suspended in midair.

Still further, in the present invention, a reflection-surface treatment can be performed on the inner surface of the rear-face wall of the lamp body. With this reflection-surface treatment applied, it is possible when the LED light source is not lit to make the presence of the reflector further inconspicuous due to the action of reflection of exterior light, reaching the inside of the lamp chamber, at the rear-face wall. Further, it is possible, when the LED light source is lit, for the rear-face wall to be irregularly shone by the scattered light in the lamp chamber to provide a three-dimensional appearance or a sense of depth for the lamp design.

Regarding the reflector, only one reflector can be provided; but by way of providing a plurality of reflectors, the reflectors can appear to be lit as if they are suspended in midair at a plurality of locations within the lamp chamber. This further enhances the originality of the lamp design.

DETAILED DESCRIPTION OF THE INVENTION

Figure 1:
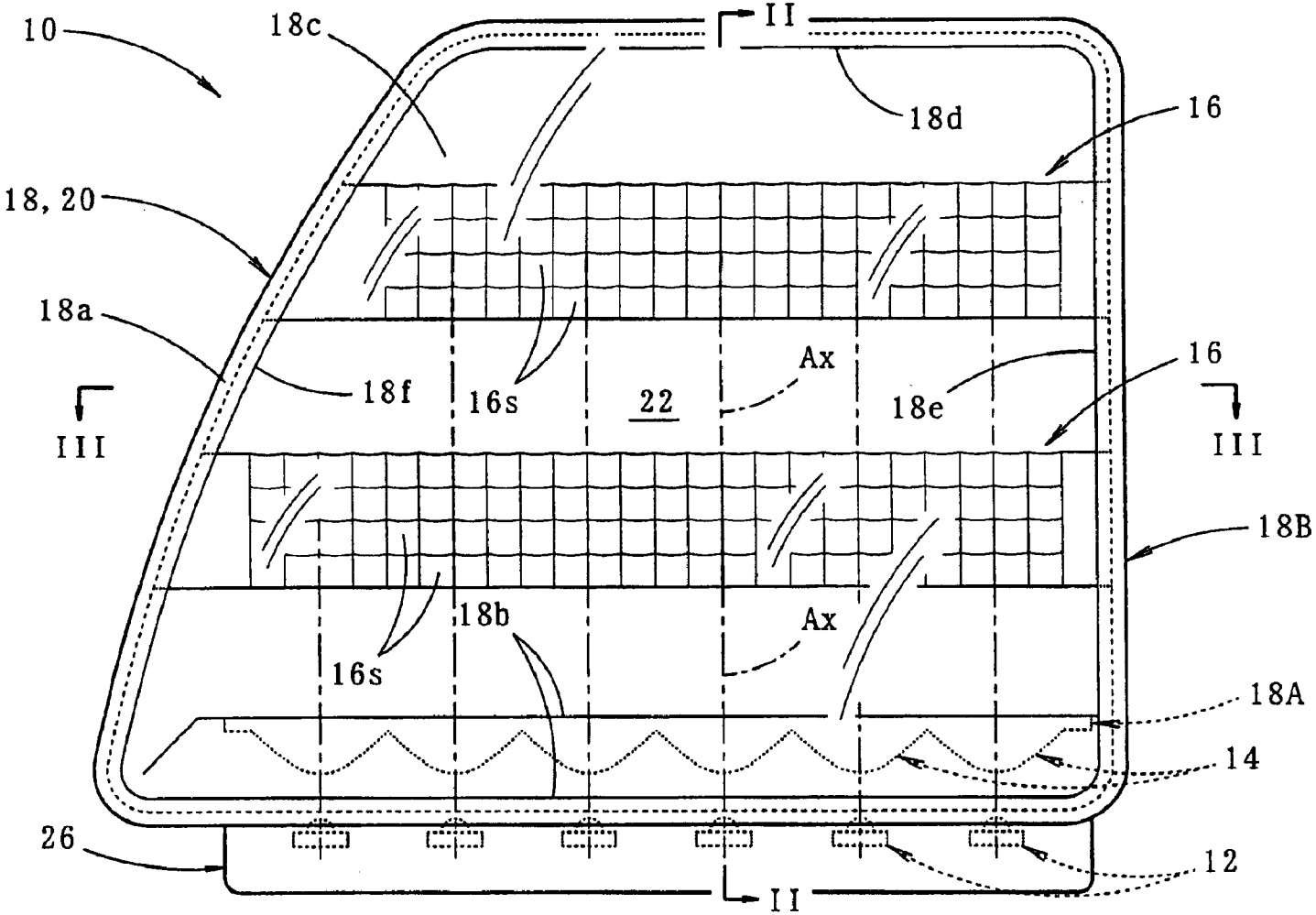
FIG. 1 is a front elevational view of a vehicular lamp according to one embodiment of the present invention.

Hereafter, one embodiment of the present invention will be described with reference to the accompanying drawings.

As illustrated in FIGS. 1 through 4, the vehicular lamp 10 of the shown embodiment is a tail lamp mounted in the rear end portion of the vehicle, and it includes a plurality (eleven) of LED light sources 12 disposed upward, a plurality (eleven) of optical members 14 for forming light from each one of the LED light sources 12 into respective parallel light fluxes, and a plurality (two) of reflectors 16 reflecting the parallel light fluxes from the optical members 14 in the forward direction of the lamp. In the vehicular lamp 10, the two reflectors 16 are incorporated in a lamp chamber 22 constituted by a lamp body 18 and a plain-configured translucent cover 20 mounted on a front-end opening 18*a* of the lamp body 18.

Figure 5:
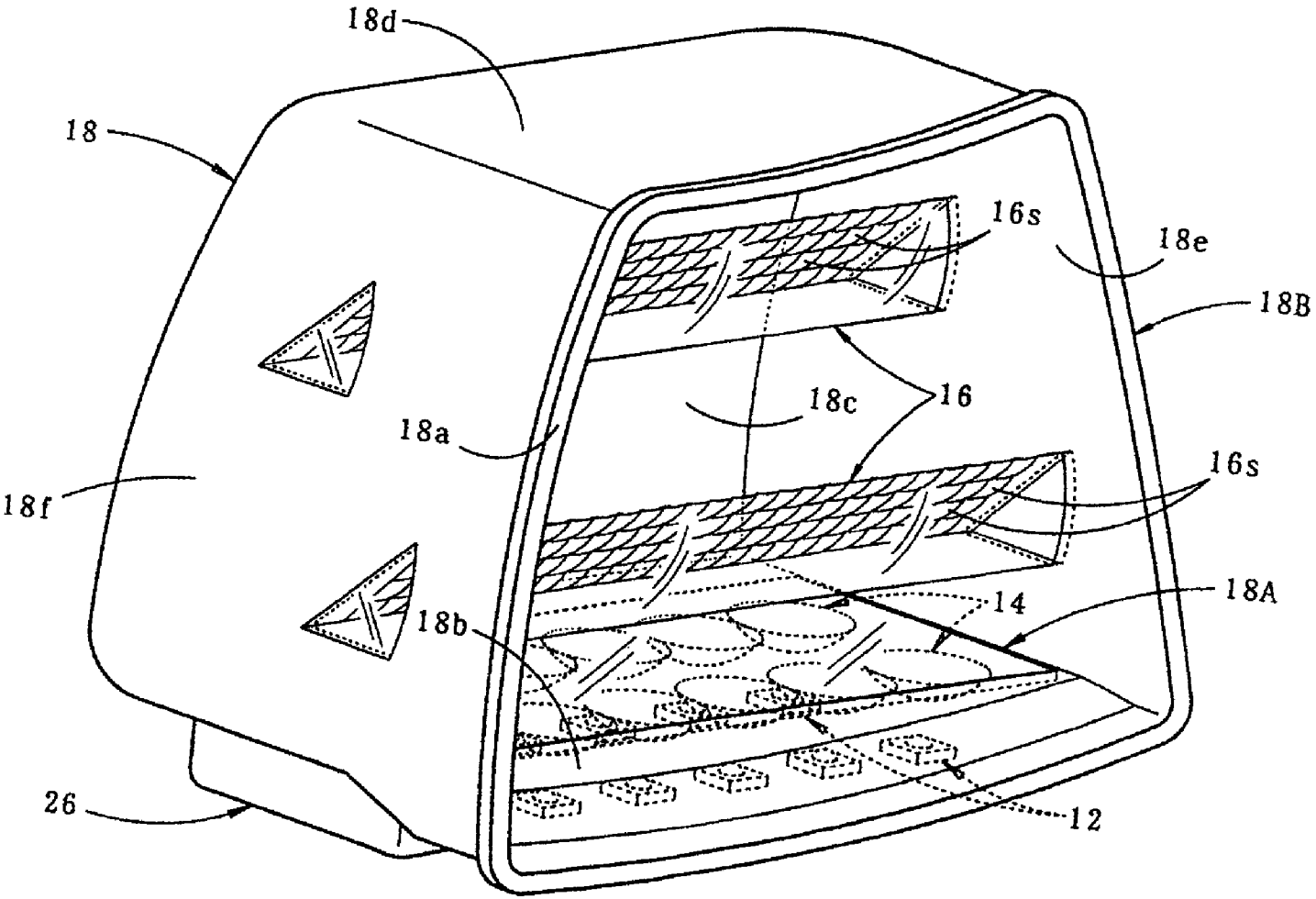
FIG. 5 is a perspective view of the vehicular lamp without a translucent cover.

FIG. 5 illustrates the vehicular lamp 10 with its translucent cover 20 removed.

As seen from FIG. 5, the lamp body 18 has a bottom-face wall 18*b* part of which serves as a translucent portion 18A. Outside (under) the translucent portion 18A, the foregoing sets of the LED light sources 12 and the optical members 14 are arranged. The inner face of a body portion 18B (all parts except the translucent portion 18A) in the lamp body 18 is subjected to reflection-surface treatment using aluminum vapor deposition or the like over the full range thereof. A rear-face wall 18*c* of the lamp body 18 has a curved face arcing in a vertical direction.

The bottom-face wall 18*b* of the lamp body 18 extends along a horizontal plane; but the front area of the bottom-face wall 18*b* is formed to slope down to a lower level toward the front-end opening 18*a*.

The translucent portion 18A is a laterally rectangular-shaped translucent panel disposed horizontally, and on the underside of which the plurality of optical members 14 are integrally formed as planoconvex lenses.

The optical members 14 are arranged in fore-and-aft two lines in the right-left direction. More specifically, six of the optical members 14 are provided in the front row and five of the optical members 14 are provided in the back row, with a degree of space provided between the front and back rows, and the optical members 14 in each row are arranged such that they are in contact with each other in the right-left direction.

Figure 4:
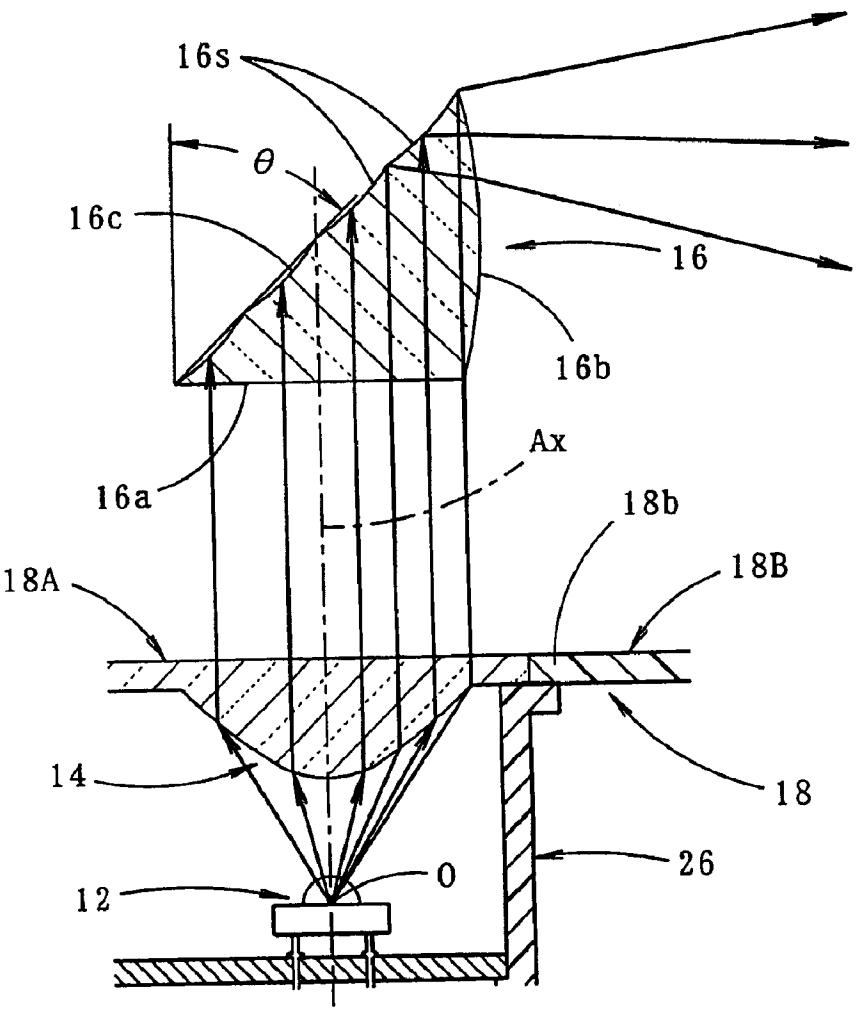
FIG. 4 is a detailed view of the portion IV in FIG. 2.

As illustrated in FIG. 4, each one of the LED light sources 12 is disposed upward in the vicinity of the underside of each optical member 14. Here, each LED light source 12 is provided such that an emission center O thereof is positioned at the focal point of each optical member 14 on an optical axis Ax of the optical member 14 concerned. Each one of the LED light sources 12 is supported by a substrate 24 and fixed on the bottom-face wall 18*b* of the lamp body 18 through a substrate supporting member 26.

Each of the foregoing reflectors 16 is formed by a translucent member provided at a distance from the bottom-face wall 18*b*, the rear-face wall 18*c* and a top-face wall 18*d* of the lamp body 18, and it is structured so as to allow the parallel light fluxes from the optical member 14 to undergo internal reflection in the reflector 16 so as to be reflected in the forward direction of the lamp. Each reflector 16 is formed in a right-angled prism configuration having a substantially triangular cross-section extending lengthwise in the right-left direction, and is supported by a left side-face wall 18*e* and a right side-face wall 18*f* of the lamp body 18 at its left and right ends.

One of the two reflectors 16 is provided directly above the six sets of the LED light sources 12 and the optical members 14 arranged in the front row, and the other reflector 16 is provided directly above the five sets of the LED light sources 12 and the optical members 14 arranged in the back row. Here, in order for the two reflectors 16 not to overlap each other when viewed from the front side of the lamp, the reflector 16 of the back row is provided somewhat higher than the reflector 16 of the front row.

As illustrated in FIG. 4, each one of the reflectors 16 has a bottom face 16*a*, which is a horizontal plane, and a front face 16*b*, which is a cylindrically curved face and extends in the right-left direction of the lamp such that it arcs toward the front with respect to the vertical plane. The reflector 16 further includes an inclined back-face 16*c* which is formed by a plurality of reflective elements 16*s* formed in a concave spherical configuration on a flat inclined face forming an angle θ (θ=45 degrees) with respect to the vertical plane. The inclined back-face 16*c* is divided into sixteen grid-configured sections for each set of an LED light source 12 and an optical member 14, and a reflection element 16*s* is provided in each section.

The light emitted from each of the LED light sources 12 and then formed into parallel light fluxes by the corresponding optical member 14 vertically strikes the reflector 16 from the bottom face 16*a* of the reflector 16, and then it is reflected by the inclined back-face 16*c* in the forward direction of the lamp; and in this process, a plurality of reflection elements 16*s* that form the inclined back-face 16*c* executes diffuse reflection in the up-down and right-left directions. The resulting light exits from the front face 16*b* of the reflector 16 in the forward direction of the lamp, and the light is further diffused at this point in the up-down direction by the cylindrically curved face that forms the front face 16*b*.

Figure 6:
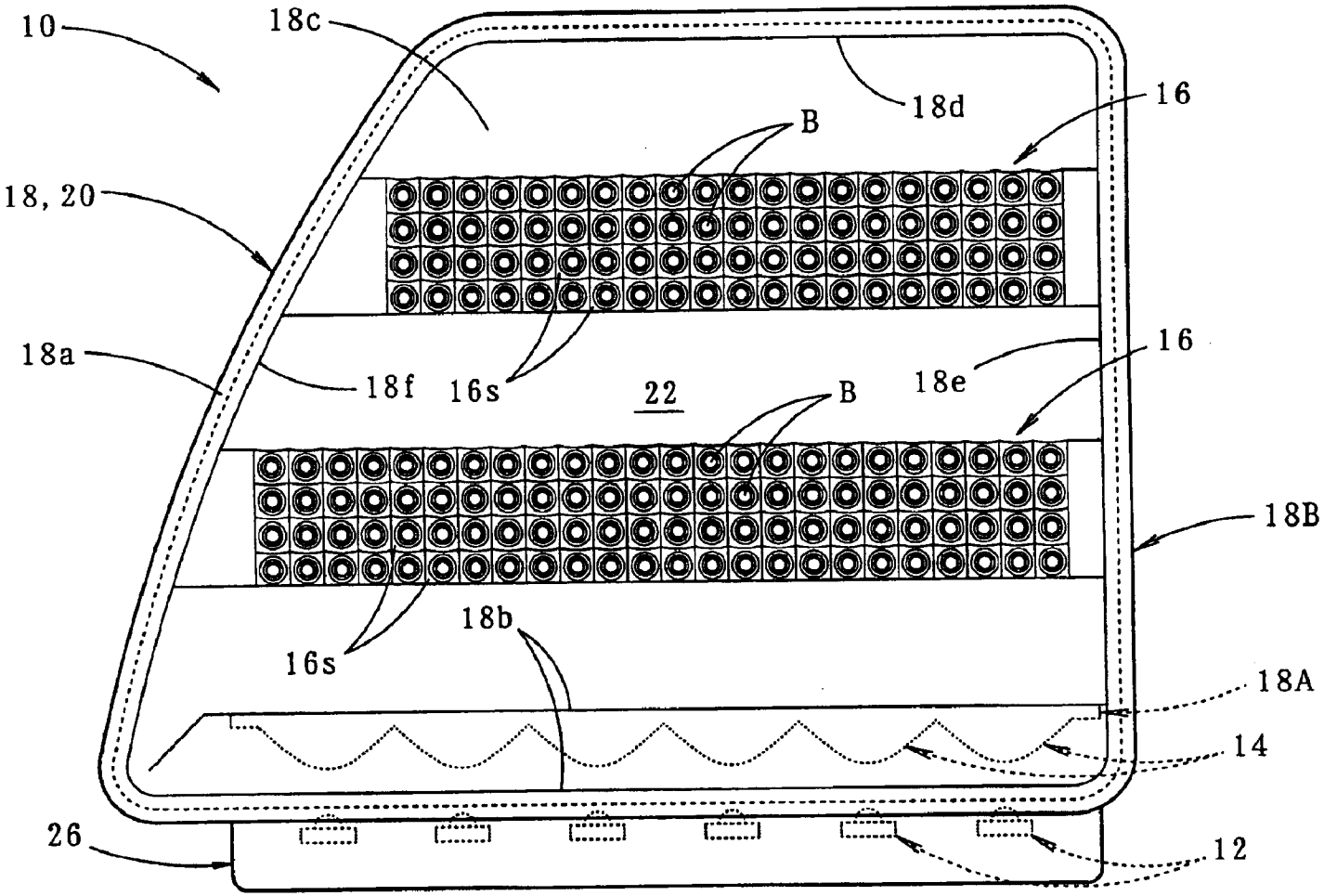
FIG. 6 is a front elevational view of the vehicular lamp when the LED light source is lit.

FIG. 6 shows the front of the vehicular lamp 10 when the LED light source 12 is lit.

As seen from FIG. 6, when the vehicular lamp 10 is seen from the front, the plurality of reflection elements 16*s* of each reflector 16 appear to shine as a luminescent portion B. Here, because of the arrangement in two upper and lower levels of the reflectors 16 each extending in the right-left direction, two laterally extending bands appear to be lit brightly inside the lamp chamber 22.

Even when the angle of view is gradually shifted to a degree from directly in front of the lamp, part of each of the reflection elements 16*s* deviating from the central portion in accordance with the degree of shifting of the angle of view appear to be lit brightly as the luminescent portion B, because the parallel light fluxes from each of the optical members 14 are incident on the corresponding reflection elements 16*s*.

Further, since a reflection-surface treatment is applied to the inner face of the body portion 18B of the lamp body 18 for its entirety, the back-face wall 18*c* of the lamp body 18 appear to shine irregularly due to the scattered light inside the lamp chamber 22.

As described above in detail, in the vehicular lamp 10 of the shown embodiment, the light from the LED light source 12 is formed into parallel light fluxes by the optical member 14, and then the parallel light fluxes from the optical members 14 are reflected in the forward direction of the lamp by the reflectors 16. Moreover, the reflectors 16 are provided inside the lamp chamber 22 that is formed by the lamp body 18 and the translucent cover 20, and part of the bottom-face wall 18*b* of the lamp body 18 is formed as the translucent portion 18A, and the LED light sources 12 and the optical members 14 are provided outside the translucent portion 18A. Further, each reflector 16 is formed by a translucent member that is provided at a distance from the translucent portion 18A and from the rear-face wall 18*c* of the lamp body 18, and the reflector 14 is structured so that the parallel light fluxes from the optical member 14 undergo internal reflection in the reflector 16 so as to be reflected in the forward direction of the lamp. Because of this structure, the vehicular lamp 10 has such advantages as described below.

It is possible to make the presence of the reflector 16 inconspicuous when the LED light source is not lit. This is because the reflector 16 concerned is formed by the translucent member so as to reflect the parallel light fluxes, travelling from the optical member 14, in the forward direction of the lamp through internal reflection. Further, it is possible to make the presence of the LED light source 12 and the optical member 14 inconspicuous when the LED light source 12 is lit and also when it is not lit. This is because they are provided outside the translucent portion 18A that forms part of the bottom-face wall 18*b* of the lamp body 18.

Further, the reflector 16 is provided at a distance from the translucent portion 18A and the rear-face wall 18*c* of the lamp body 18, and thus it is possible for the reflector 16 to appear to be lit as if the reflector 16 is suspended in midair within the lamp chamber 22 when the LED light source 12 is lit. Moreover, since the LED light sources 12 and the optical members 14 are provided outside the translucent portion 18A, how the reflector 16 is lit is not easily recognized.

As seen from the above, when the LED light source 12 is not lit, it is difficult to predict how the illumination of the reflector 16 will appear when the LED light source 12 is lit; and when the LED light source 12 is lit, the reflector 16 appears to be lit as if it is suspended in midair within the lamp chamber 22. It is thus possible to give unexpectedness in changes in the appearance of the lamp when the LED light source 12 is lit. This, in turn, makes enhancement in the originality of the lamp design possible.

Furthermore, the vehicular lamp 10 of the shown embodiment uses the LED light sources 12 as its light source. As a result, even though the LED light sources 12 and the optical members 14 are provided outside the translucent portion 18A, the lamp can be made relatively compact.

In the embodiment, particularly, the optical member 14 is formed integrally with the translucent portion 18A of the lamp body 18. Accordingly, the number of parts can be reduced, and the lamp can be compact.

Further, in the shown embodiment, the reflector 16 extends in the right-left direction of the lamp and has the right and left end portions supported by the lamp body 18. Also, the translucent portion 18A is provided in the bottom-face wall 18*b* of the lamp body 18. Furthermore, a plurality of sets of the LED light sources 12 and the optical members 14 are provided so as to be arranged in the right-left direction. Accordingly, when the LED light source 12 is lit, the reflector 16 appears to be lit as the band-shaped translucent portion B extending in the right-left direction as if the reflector 16 is suspended in the midair.

Still further, in the embodiment, a reflection-surface treatment is applied to the whole range of the inner surface of the body portion 18B, including the rear-face wall 18*c*, of the lamp body 18. Accordingly, when the LED light source 12 is not lit, the presence of the reflector 16 is further inconspicuous due to the action of reflection of the exterior light, reaching the inside of the lamp chamber 22, at the rear-face wall 18*c*. When the LED light source 12 is lit, on the other hand, the rear-face wall 18*c* is irregularly shone by scattered light in the lamp chamber 22, and a three-dimensional appearance or a sense of depth for the lamp design is provided. Such effects can be obtained to some extent by way of applying the reflection-surface treatment to the inner face of the rear-face wall 18*c* alone.

In the shown embodiment, the front face 16*b* of the reflector 16 is a cylindrically curved face. Thus, when the LED light source 12 is not lit, it is possible to prevent exterior light reaching the inside of the lamp chamber 22 from specularly reflecting from the front face 16*b* of the reflector 16 to cause the front face 16*b* to appear to be lit in a flat-plate configuration. It is thus also possible to make the presence of the reflector 16 further inconspicuous. In addition, in the embodiment, the rear-face wall 18*c* of the lamp body 18 is a curved face arcing in the up-down direction. Accordingly, when the LED light source 12 is not lit, it is possible to prevent exterior light, reaching the inside of the lamp chamber 22, from specularly reflecting from the rear-face wall 18*c* to cause the rear-face wall 18*c* to appear to be lit in a flat-plate configuration. It is thus also possible to make the presence of the reflector 16 further inconspicuous.

Still further, the embodiment includes two reflectors 16, and they are provided in the upper and lower levels. This makes the reflectors 16 appear to be lit in the form of two laterally extending bands in the lamp chamber 22, further enhancing the originality of the lamp design.

A first modification of the foregoing embodiment will be described below.

Figure 2:
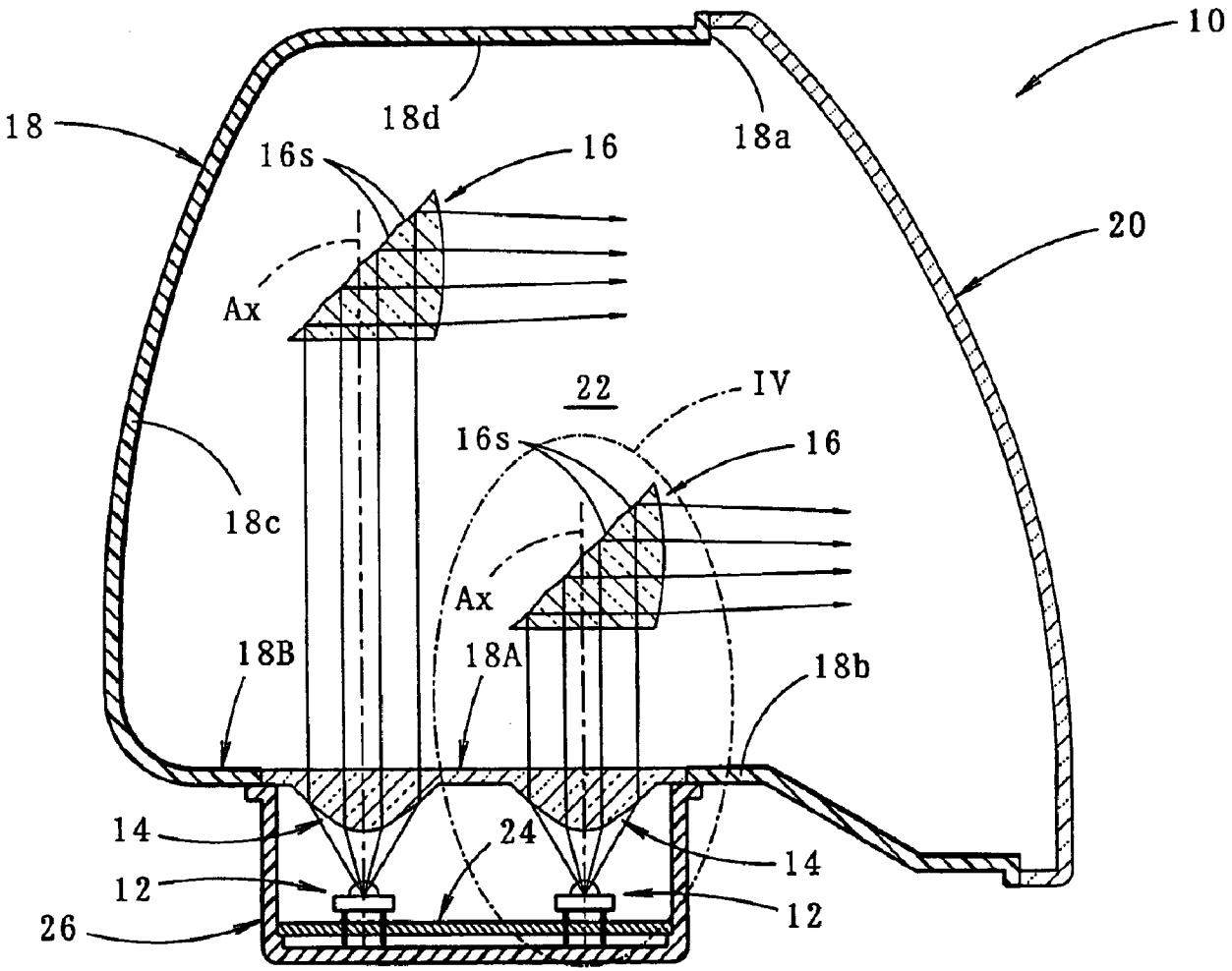
FIG. 2 is a sectional view taken along the line II—II in FIG. 1.
Figure 3:
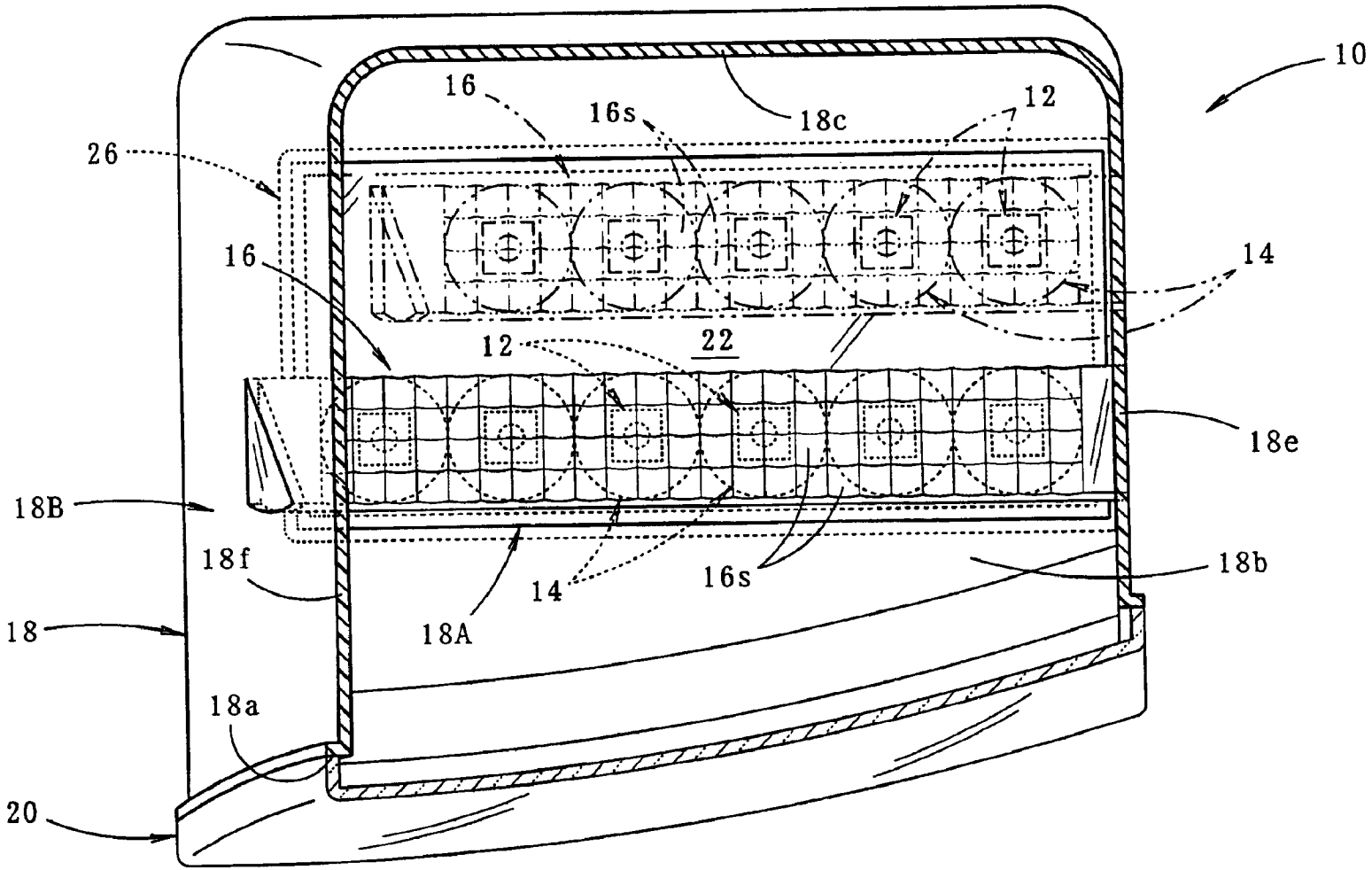
FIG. 3 is a sectional view taken along the line III—III in FIG. 1.
Figure 7:
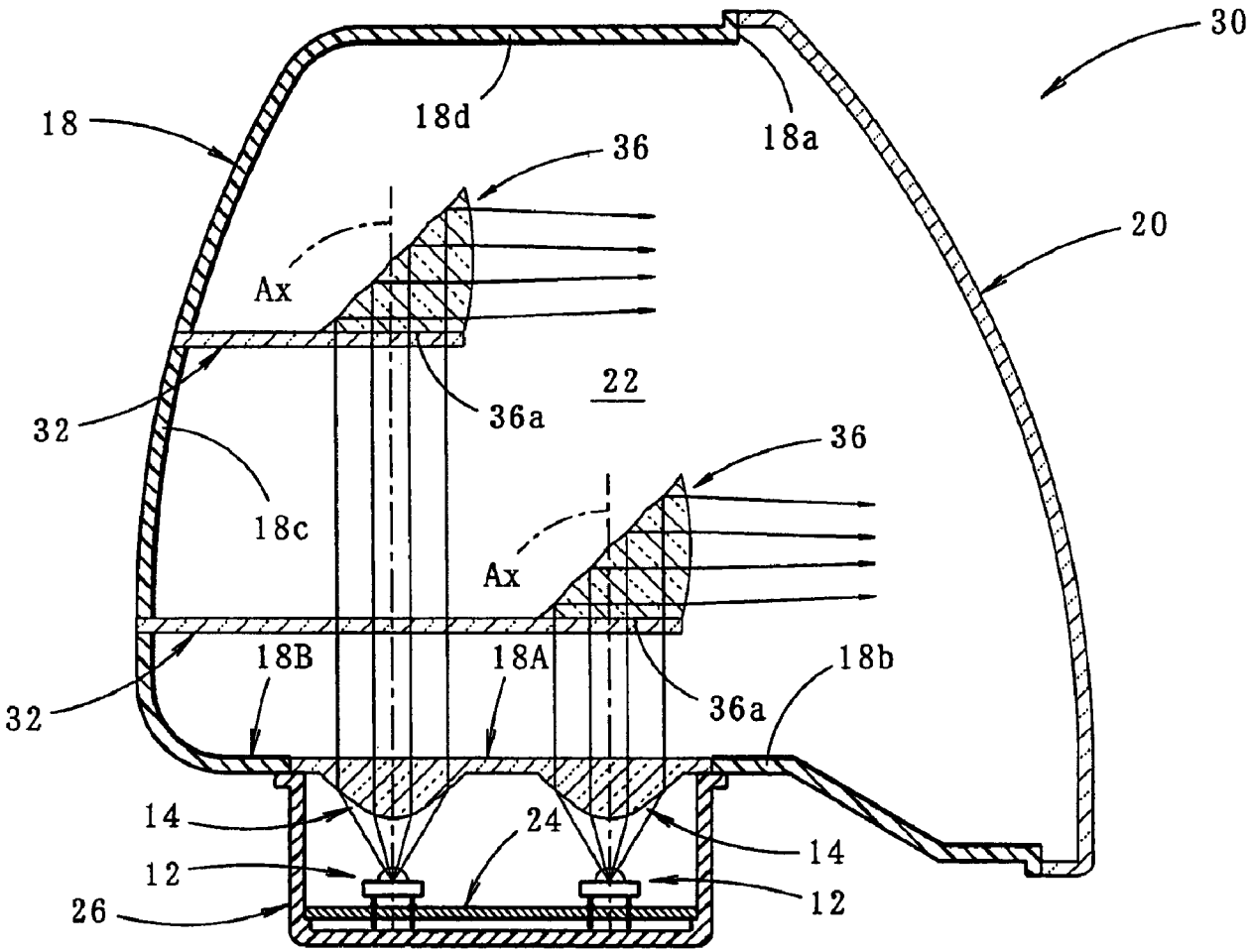
FIG. 7 shows, in a similar way to FIG. 2 and in cross-section, a vehicular lamp according to a first modification of the embodiment of the present invention.
Figure 8:
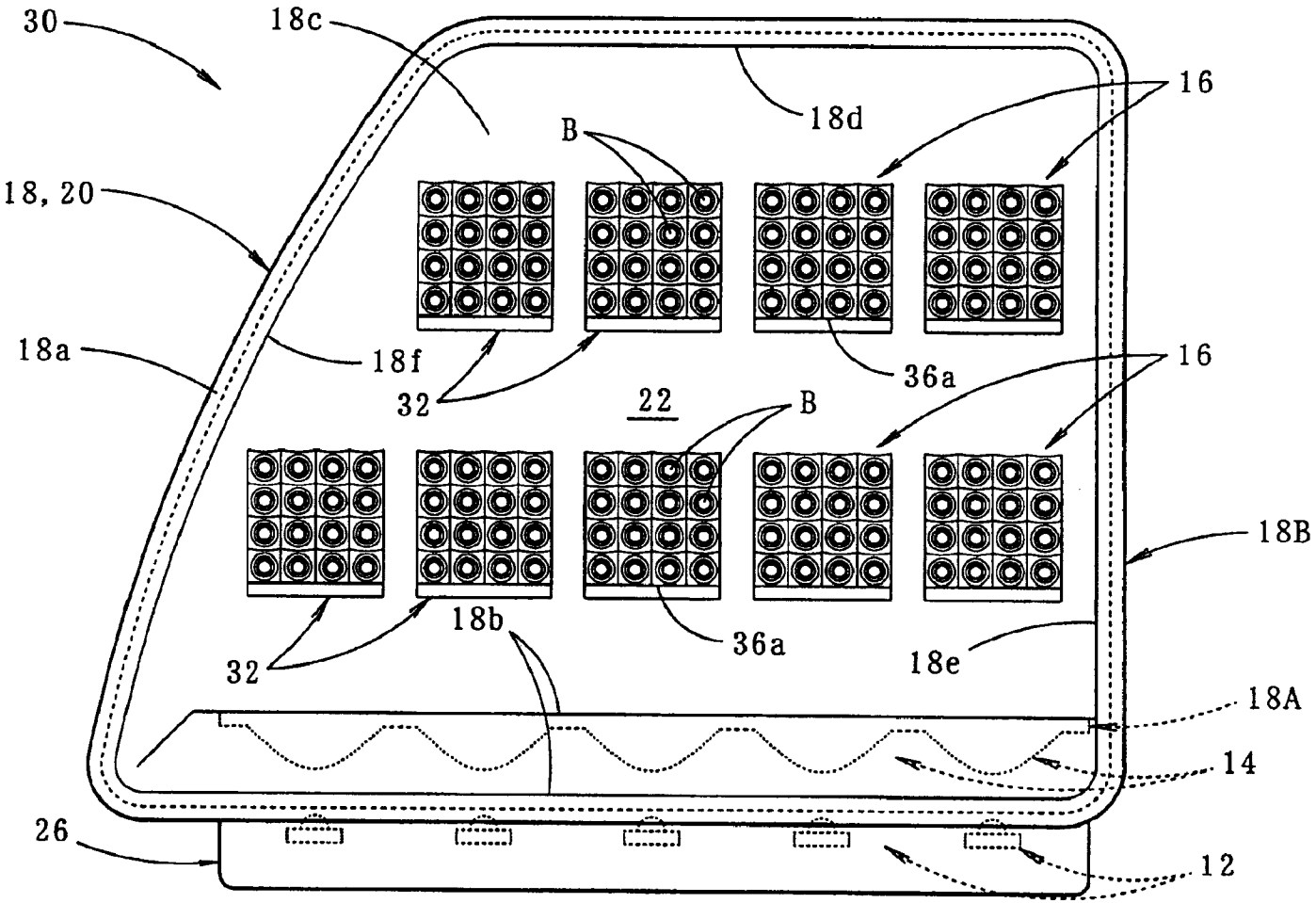
FIG. 8 shows, in a similar way to FIG. 6, the vehicular lamp of the first modification.

FIGS. 7 and 8 illustrate in a similar way to FIGS. 2 and 6 a vehicular lamp 30 of the first modification.

As seen from FIGS. 7 and 8, the vehicular lamp 30 has a different reflector 36 from that of the vehicular lamp 10.

More specifically, the reflector 36 is formed in a right-angled prism configuration having a substantially triangular cross-section. In this regard, the reflector 36 is the same as the reflector 16 of the foregoing embodiment. However, the reflector 36 does not extend lengthwise in the right-left direction as the reflector 16 does, and it is formed in a block configuration for each set of the LED light source 12 and the optical member 14. Nine reflectors 36 are arranged in two, upper and lower, levels (four in the upper level, and five in the lower level). Each one of those reflectors 36 is supported by the rear-face wall 18*c* of the lamp body 18 through a transparent support plate 32 on which the bottom face 36*a* of the reflector 36 is fixed.

In this structure of the first modification as well, when the LED light source 12 is not lit, it is difficult to predict how the illumination of the reflector 36 will appear when the LED light source 12 is lit. When on the other hand the LED light source 12 is lit, the reflector 36 appears to be lit as if the reflector 36 is suspended in midair. It is thus possible to give unexpected changes in the appearance of the lamp when the LED light source 12 is lit. In addition, the appearance of the lamp has a different interesting effect from that in the foregoing embodiment.

A second modification of the foregoing embodiment will be described below.

Figure 9:
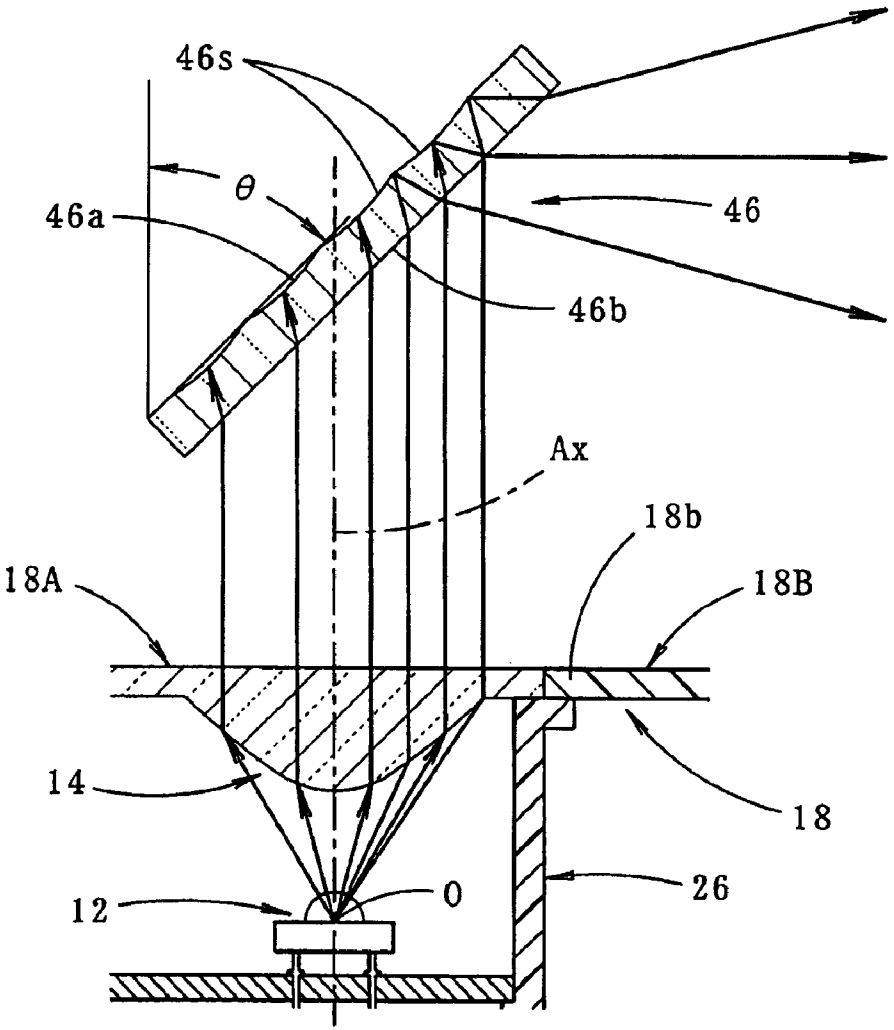
FIG. 9 shows, in a similar way to FIG. 4, the reflector according to a second modification of the embodiment of the present invention.

FIG. 9 illustrates in a similar way to FIG. 4 a reflector 46 of this second modification.

As seen from FIG. 9, the reflector 46 is not formed in the right-angled prism configuration. Rather, it is formed in a mirror configuration.

As in the case of the inclined rear-face 16*c* of the reflector 16 of the foregoing embodiment, the inclined rear-face 46*a* of the reflector 46 has a plurality of reflective elements 46*s* formed in a concave spherical configuration on the flat inclined face which forms an angle θ (θ=45 degrees) with respect to the vertical plane.

In this structure as well, when the LED light source 12 is not lit, it is difficult to predict how the illumination of the reflector 46 will appear when the LED light source 12 is lit. When the LED light source 12 is lit, the reflector 46 appears to be lit as if the reflector 46 is suspended in midair. It is thus possible to give unexpectedness in changes in the appearance of the lamp when the LED light source 12 is lit.

In this second modification, the inclined front-face 46*b* of the reflector 46 is flat, but it can be a curved face.

In the above-described embodiment and modifications, the reflectors 16, 36 and 46 reflect the parallel light fluxes, traveling from the optical member 14, in a diffused manner in the forward direction of the lamp. However, instead of such a structure, the reflector can be designed so as to allow a simple specular reflection to occur in the forward direction of the lamp. In this structure, the translucent cover 20, or alternatively, an inner lens or the like which is additionally provided has a diffuse control function.

In the shown embodiment and modifications, the LED light source 12 is disposed upward, but it can be provided to face in another direction. In such cases, by employing a structure similar to the foregoing embodiment and modifications, the effects similar to those in the embodiment and modifications are obtained.

Furthermore, in the embodiment and modifications, the vehicular lamps 10 and 30 are the tail lamps. However, in other types of vehicular lamps (e.g., a stop lamp, a tail & stop lamp, a clearance lamp, a turn-signal lamp, or the like), with an employment of the structure similar to that of the foregoing embodiment and modifications, the effects similar to those in the embodiment and modifications are obtained.

What is claimed is:

1. A vehicular lamp comprising:

an optical member that forms light from an LED light source into parallel light fluxes, and a reflector that reflects said parallel light fluxes, traveling from said optical member, in a forward direction of said lamp, said reflector being housed in a lamp chamber formed by a lamp body and a translucent cover which is attached to a front-end opening of said lamp body; wherein said lamp body is provided in part of a circumferential face thereof with a translucent portion, and said reflector is comprised of a translucent member provided at a distance from said translucent portion and from a rear-face wall of said lamp body and allows said parallel light fluxes from said optical member to undergo internal reflection in said reflector so as to be reflected in said forward direction of said lamp.

2. The vehicular lamp according to claim 1, wherein said optical member is formed integrally with said translucent portion.

3. The vehicular lamp according to claim 1, wherein said reflector extends in a right-left direction of said lamp and is supported at right and left ends thereof by said lamp body, said translucent portion is provided in a bottom-face wall of said lamp body, and said LED light source and said optical member make a set and are provided in a plurality of numbers by being arranged in a right-left direction of said lamp.

4. The vehicular lamp according to claim 1, wherein an inner surface of said rear-face wall of said lamp body is subjected to reflection-surface-treatment.

5. The vehicular lamp according to claim 1, wherein said reflector is provided in a plurality of numbers.

6. The vehicular lamp according to claim 2, wherein said reflector extends in a right-left direction of said lamp and is supported at right and left ends thereof by said lamp body, said translucent portion is provided in a bottom-face wall of said lamp body, and said LED light source and said optical member make a set and are provided in a plurality of numbers by being arranged in a right-left direction of said lamp.

7. The vehicular lamp according to claim 6, wherein an inner surface of said rear-face wall of said lamp body is subjected to reflection-surface-treatment.

8. The vehicular lamp according to claim 7, wherein said reflector is provided in a plurality of numbers.

9. The vehicular lamp according to claim 3, wherein an inner surface of said rear-face wall of said lamp body is subjected to reflection-surface-treatment.

10. The vehicular lamp according to claim 9, wherein said reflector is provided in a plurality of numbers.

11. The vehicular lamp according to claim 3, wherein said reflector is provided in a plurality of numbers.

* * * * *